US008960258B2

(12) United States Patent
Hendriks et al.

(10) Patent No.: US 8,960,258 B2
(45) Date of Patent: Feb. 24, 2015

(54) DEVICE FOR WINDING UP AND UNWINDING RAISING CORDS OF A SCREEN SUCH AS A WINDOW COVERING

(75) Inventors: Wouter Hendriks, Enschede (NL); Harry Davids, Raalte (NL); Ruben Hubert Jan De Vries, Zevenaar (NL); Bastiaan Franciscus Klein Tuente, Groenlo (NL)

(73) Assignee: Coulisse B.V., Enter (NL)

( * ) Notice: Subject to any disclaimer, the term of this patent is extended or adjusted under 35 U.S.C. 154(b) by 716 days.

(21) Appl. No.: 13/178,310

(22) Filed: Jul. 7, 2011

(65) Prior Publication Data

US 2012/0006929 A1 Jan. 12, 2012

(30) Foreign Application Priority Data

Jul. 8, 2010 (NL) ..... 20005059

(51) Int. Cl.

| | |
|---|---|
| ***E06B 9/30*** | (2006.01) |
| ***E06B 9/305*** | (2006.01) |
| ***E06B 9/386*** | (2006.01) |
| ***E06B 9/388*** | (2006.01) |
| ***E06B 9/326*** | (2006.01) |
| ***E06B 9/322*** | (2006.01) |

(52) U.S. Cl.

CPC ..... *E06B 9/326* (2013.01); *E06B 9/322* (2013.01); *E06B 2009/3225* (2013.01); *E06B 2009/3227* (2013.01)

USPC ..... 160/170; 160/173 R

(58) Field of Classification Search

USPC ..... 160/168.1 R, 169, 170, 171, 173 R, 160/178.1 R; 242/396, 396.1, 396.8

See application file for complete search history.

(56) References Cited

U.S. PATENT DOCUMENTS

| | | | | |
|---|---|---|---|---|
| 5,996,667 | A * | 12/1999 | Fun | 160/84.01 |
| 7,654,300 | B2 * | 2/2010 | Chigusa | 160/170 |
| 2007/0102554 | A1 * | 5/2007 | Chen | 242/389 |
| 2007/0169897 | A1 * | 7/2007 | Lin | 160/171 |

* cited by examiner

*Primary Examiner* — Katherine Mitchell
*Assistant Examiner* — Jeremy Ramsey
(74) *Attorney, Agent, or Firm* — Jensen & Puntigam, PS

(57) ABSTRACT

The invention relates to a device (1) for winding up and unwinding raising cords of a screen, comprising:

an elongate housing (2);

a shaft (3) intended for rotation in the housing;

a number of winding rollers (4) which are coaxially mountable on the shaft for winding up and unwinding the raising cords (5) and which are adapted for releasable fastening of the raising cords;

a number of winding roller holders (6) for bearing-mounted support of the winding rollers, which winding roller holders are adapted to be received in the housing. The device further comprises a number of blocking elements (10), each arranged on one of the winding rollers, for blocking one of the degrees of freedom of movement of the winding rollers, wherein each blocking element is movable between an assembly position, in which the respective winding roller is blocked against rotation, and a position of use in which the respective winding roller is blocked against translation, wherein the blocking elements are adapted for releasable fastening of one of the raising cords.

3 Claims, 3 Drawing Sheets

DEVICE FOR WINDING UP AND UNWINDING RAISING CORDS OF A SCREEN SUCH AS A WINDOW COVERING

TECHNICAL FIELD

The present invention relates to a device for winding up and unwinding raising cords of a screen, such as a window covering, comprising an elongate housing, a shaft intended for rotation in the housing, a number of winding rollers coaxially mountable on the shaft for winding up and unwinding the raising cords, wherein the winding rollers are adapted for releasable fastening of one of the raising cords, and a number of winding roller holders for bearing-mounted support of the winding rollers, which winding roller holders are adapted to be received in the housing.

BACKGROUND ART

Such a device is known in the field, for instance from European patent application EP 1647666 of the same applicant.

The known device simplifies assembly due to the releasable fastening of the raising cords to the winding rollers but has the drawback that in the case of a plurality of winding rollers mutual alignment thereof is necessary prior to passing the shaft therethrough. Once the shaft has been passed through the winding rollers, the winding rollers must then be mounted fixedly on the shaft in order to make the device ready for use.

DISCLOSURE OF THE INVENTION

The present invention has for its object to provide a device of the type stated in the preamble with a further simplified assembly.

The device according to the invention has for this purpose the feature that the device further comprises a number of blocking elements, each arranged on one of the winding rollers, for blocking one of the degrees of freedom of movement of the winding rollers, wherein each blocking element is movable between an assembly position, in which the respective winding roller is blocked against rotation around the shaft, and a position of use in which the respective winding roller is blocked against translation along the shaft, wherein the blocking elements are adapted for releasable fastening of the raising cords.

In the assembly position of a blocking element in the device according to the invention each winding roller is blocked against rotation. The winding rollers automatically take on the same orientation and can be placed successively on a shaft. The respective winding roller is blocked against translation by moving the blocking element to the position of use.

In a practical embodiment the blocking elements are each movable substantially transversely of the shaft.

In the first preferred embodiment the blocking elements each protrude out of the elongate housing in the assembly position. The blocking elements are hereby accessible to a user for the purpose of the releasable fastening of one of the raising cords. Depending on the chosen dimensions of the blocking elements, the longitudinal opening of the elongate housing can remain narrow, this resulting in an aesthetic advantage. The winding roller on which the blocking element is mounted is also limited in rotation inside the housing due to the protruding blocking element.

According to a second preferred embodiment, the blocking elements each engage clampingly on the shaft in the position of use. As a result the winding roller on which the blocking element is mounted is fixed on the shaft.

According to a further preferred embodiment, each winding roller is provided on the outer end thereof with a flange-like unit which is adapted to receive the blocking element.

According to a further preferred embodiment, each blocking element is provided with resilient legs provided with barbs, and each flange-like unit is provided with barb openings for receiving the barbs. This preferred embodiment provides a slap connection with which the automatic taking up of the desired assembly position or position of use can be realized simply and in reliable manner.

BEST MODE FOR CARRYING OUT THE INVENTION

Figure 1:
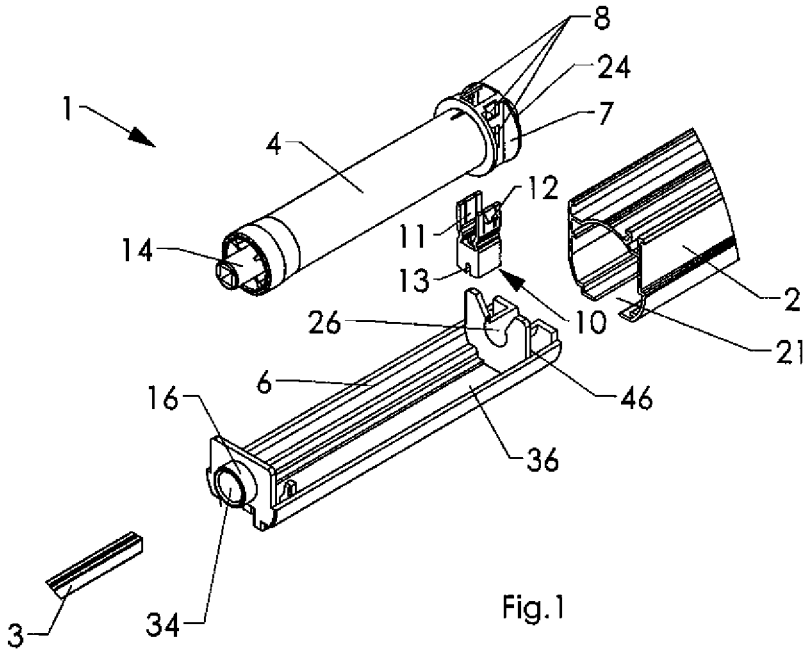
FIG. 1 shows a preferred embodiment of the device according to the invention with exploded parts.

FIG. 1 shows a first preferred embodiment of a device 1 according to the present invention. Device 1 is provided with an elongate housing 2. The elongate housing or rail 2 serves for mounting of device 1 on a wall or ceiling.

Extending in elongate housing 2 is a shaft 3 which is intended for rotation in housing 2. Mounted coaxially on shaft 3 are winding rollers 4 for winding up and unwinding raising cords 5 (see FIGS. 3 and 4). Device 1 further comprises a number of winding roller holders 6 for bearing-mounted support of winding rollers 4. Winding roller holders 6 are adapted to be received in housing 2.

Figure 2:
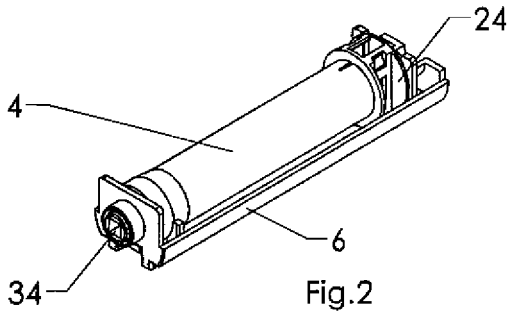
FIG. 2 shows a part of the device of FIG. 1 in assembled state.

FIG. 2 shows the winding roller holder 6 with winding roller 4 received therein. All of the components of FIG. 2 are intended to be received inside housing 2.

Winding roller 4 is provided at both outer ends with narrowed end zones 14, 24 respectively. Winding roller holder 6 is provided with a bearing bush 16 and a bearing surface 26 for bearing-mounted support of end zones 14, 24 of winding roller 4. A shaft passage 34 for receiving shaft 3 extends through winding roller 4.

Figure 3:
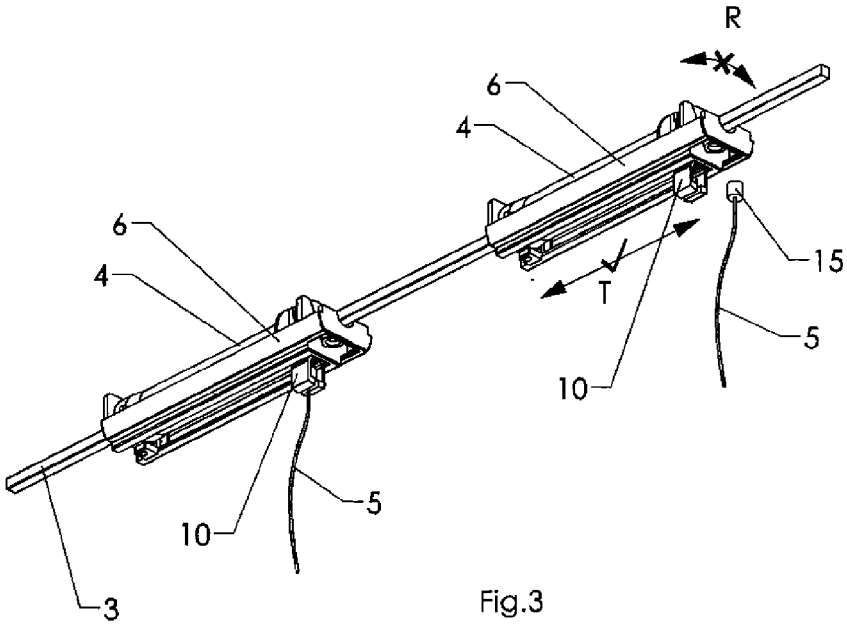
FIG. 3 shows the part of FIG. 2 in the assembly position.
Figure 4:
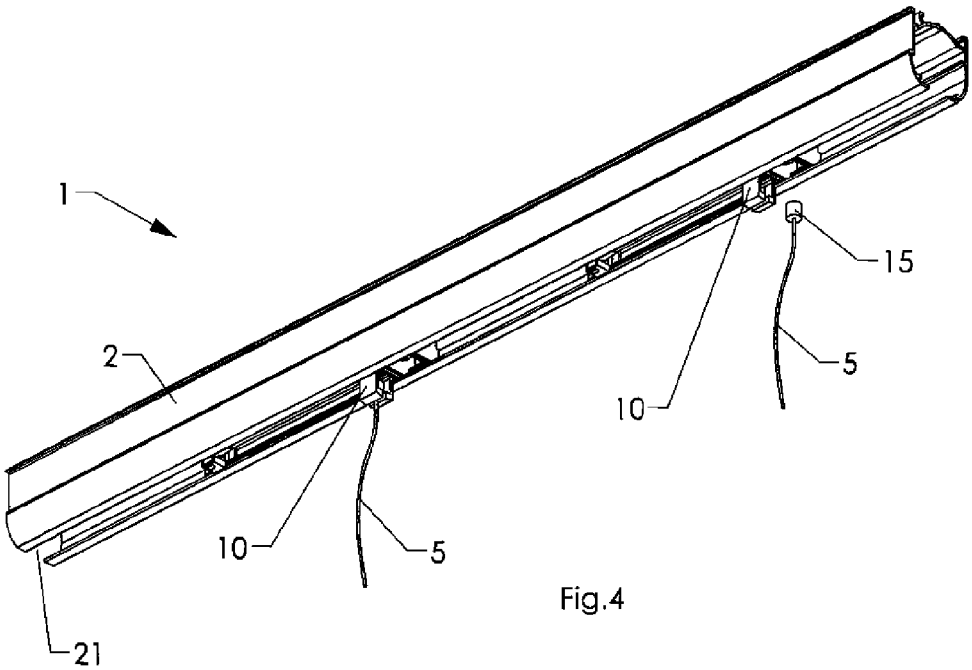
FIG. 4 shows the components of FIG. 3 in the housing.
Figure 5:
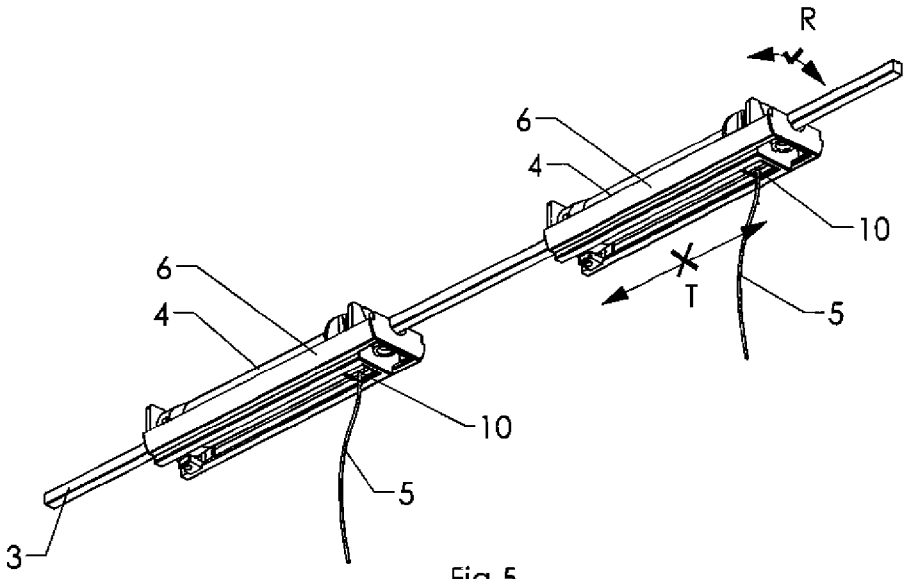
FIG. 5 shows the components of FIG. 2 in the position of use.
Figure 6:
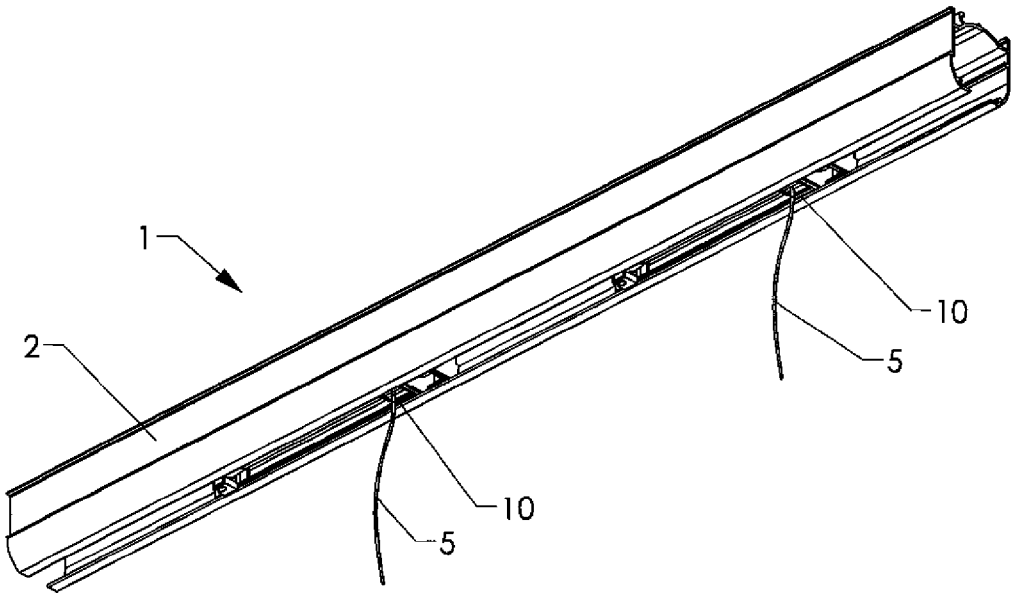
FIG. 6 shows the components of FIG. 5 in the housing.

Device 1 is further provided according to the invention with a number of blocking elements 10 which are each arranged on one of the winding rollers 4. Each blocking element 10 is movable between an assembly position as shown in FIGS. 3 and 4 and a position of use as shown in FIGS. 5 and 6.

Blocking element 10 comprises a pair of resilient legs 11 which are movable toward each other. Resilient legs 11 are each provided on the outside with barbs 12.

Blocking element 10 is adapted for releasable fastening of a raising cord 5. In the shown preferred embodiment blocking element 10 is provided with a through-opening 13 for receiving a raising cord 5. If desired, raising cord 5 can be provided with a fixation element 15 attached to the outer end of raising cord 5 and having a size such that raising cord 5 cannot be pulled through opening 13.

Blocking element 10 is movable substantially transversely of shaft 3. In the shown preferred embodiment winding roller 4 is provided with openings 8 for receiving barbs 12. These openings 8 are arranged in a flange-like unit 7 arranged on winding roller 4 at the position of narrowed end zone 24. In the assembled state (see FIG. 2) flange-like unit 7 lies against support 46 on winding roller holder 6.

According to the invention blocking element 10 is movable between an assembly position (shown in FIGS. 3 and 4), in which the respective winding roller 4 is blocked against rotation Ⓡ, and a position of use (FIGS. 5 and 6) in which the respective winding roller 4 is blocked against translation (T).

In the assembly position blocking element 10 protrudes from winding roller holder 6 and elongate housing 2 through respective longitudinal openings 36, 21. Winding roller 4 can now not rotate in the direction R about shaft 3. Winding roller 4 therefore automatically takes on the desired orientation necessary for assembly. Opening 13 is moreover accessible for fastening of a raising cord 5. Winding roller holder 6 is however translatable together with winding roller 4 along shaft 3 in the direction T.

When assembly is completed, blocking element 10 can be moved from the assembly position to the position of use. In the shown preferred embodiment blocking element 10 can be displaced substantially transversely of shaft 3. The resilient legs 11 are urged toward each other and engage clampingly on shaft 3, as a result of which winding roller 4, together with winding roller holder 6, cannot translate in direction T along shaft 3. The length of blocking element 10 is chosen such that blocking element 10 is now wholly received in winding roller holder 6 and no longer protrudes from winding roller holder 6, so that winding roller 4 is released for rotation in the direction R. In the position of use device 1 is ready to use for winding up and unwinding the raising cords 5 by means of a suitable manual or automatic control mechanism for device 1.

The device according to the present invention can be applied generally for winding up and unwinding the cords of a screen such as a window covering. Examples of window coverings with raising cords are folding blinds, pleated blinds and horizontal blinds.

The invention is of course not limited to the described and shown preferred embodiment, but extends to any embodiment falling within the scope of protection as defined in the claims and as seen in the light of the foregoing description and accompanying drawings.

What is claimed is:

1. A device (1) for winding up and unwinding raising cords of a screen, such as a window covering, comprising:

an elongate housing (2);

a shaft (3) intended for rotation in the housing;

a number of winding rollers (4) coaxially mountable on the shaft for winding up and unwinding the raising cords (5), wherein the winding rollers are adapted for releasable fastening of one of the raising cords;

a number of winding roller holders (6) for bearing-mounted support of the winding rollers, which winding roller holders are adapted to be received in the housing, wherein the device further comprises a number of blocking elements (10), for releasable fastening of the raising cords, wherein the blocking elements are each arranged on one of the winding rollers, for blocking a degree of freedom of movement of the winding rollers (4), characterized in that each blocking element is movable substantially transversely of the shaft (3) between an assembly position, in which the blocking element blocks the respective winding roller against rotation around the shaft (3), and a position of use in which the blocking element blocks the respective winding roller against translation along the shaft (3), said blocking elements (10) each engage clampingly on the shaft in the position of use and protrude out of the elongate housing (2) in the assembly position.

2. A device as claimed in claim 1, wherein each winding roller (4) is provided on an outer end thereof with a flange unit (7) which is adapted to receive the blocking element.

3. A device as claimed in claim 2, wherein each blocking element is provided with resilient legs (11) provided with barbs (12) and wherein each flange unit (7) is provided with barb openings (8) for receiving the barbs.

* * * * *